US005397965A

United States Patent [19]

Gorille et al.

[11] Patent Number: 5,397,965

[45] Date of Patent: Mar. 14, 1995

[54] DEVICE FOR OPERATING A GAS DISCHARGE LAMP

[75] Inventors: Ingo Gorille, Oberriexingen; Ulrich Drews, Vaihingen-Pulverdingen; Wolfgang Jacob, Horb, all of Germany

[73] Assignee: Robert Bosch GmbH, Stuttgart, Germany

[21] Appl. No.: 104,149

[22] PCT Filed: Nov. 13, 1992

[86] PCT No.: PCT/DE92/00946

§ 371 Date: Aug. 17, 1993

§ 102(e) Date: Aug. 17, 1993

[87] PCT Pub. No.: WO93/12630

PCT Pub. Date: Jun. 24, 1993

[30] Foreign Application Priority Data

Dec. 18, 1991 [DE] Germany ..... 41 41 804.2

[51] Int. Cl.[6] ..... H05B 37/00

[52] U.S. Cl. ..... 315/209 R; 315/219; 315/DIG. 7; 315/DIG. 5; 315/307; 315/247; 315/330; 315/261; 363/15

[58] Field of Search ..... 315/209 R, DIG. 7, 241 R, 315/241 S, 241 P, 219, 205, DIG. 5, DIG. 4, 307, 271, 247, 291, 330, 335, 261; 363/15

[56] References Cited

U.S. PATENT DOCUMENTS 3,909,666 9/1975 Tenen ..... 315/241 R
4,200,823 4/1980 Keeran et al. ..... 315/241 R
4,233,546 11/1980 Berthiaume ..... 315/241 R
4,949,016 8/1990 De Bijl et al. ..... 315/DIG. 7

FOREIGN PATENT DOCUMENTS

0477621A1 4/1992 European Pat. Off. .

OTHER PUBLICATIONS

"Leuchtstofflampen-Elektronik" (Electronics for Fluorescent Lamps), *Elektor*, No. 6, 1988, pp. 14–19.

U. Tietze et al., "Halbleiter-Schaltungstechnik" (Semiconductor Circuit Technology), *Springer-Verlag*, 6th Edition, 1983, pp. 545–552.

Dr. W. Uyterhoeven, "Elektrische Gasentladungslampen" (Electrical Gas Discharge Lamps), *Springer-Verlag*, 1938, pp. 249–252.

*Primary Examiner*—Robert J. Pascal
*Assistant Examiner*—Michael Shingleton
*Attorney, Agent, or Firm*—Spencer, Frank & Schneider

[57] ABSTRACT

A device for operating a gas discharge lamp is disclosed which includes a voltage transformer preferably an inverse transformer, to whose output a bridge circuit is connected, with the lamp being disposed in the diagonal of the bridge. A component disposed in the vicinity of lamp and able to carry an electrical potential is arranged in such a manner that an electrical field is able to develop between the lamp and the component. The component is connected with that terminal at the output of the voltage transformer at which the potential is positive relative to that at the other terminal.

10 Claims, 1 Drawing Sheet

DEVICE FOR OPERATING A GAS DISCHARGE LAMP

BACKGROUND OF THE INVENTION

The invention is based on a device for operating a gas discharge lamp of the type having a voltage transformer which transforms the direct voltage of an energy source into a predetermined output voltage, and a bridge circuit connected with the output of the transformer, with the lamp being disposed in the diagonal of the bridge. The technical journal ELEKTOR, No. 6, 1988, "Leuchtstofflampen-Elektronik" [Electronics for Fluorescent Lamps], pages 14–19, discloses an electronic input device for operating a gas discharge lamp. The input device includes a voltage transformer which converts a given input voltage, in this case, for example, the mains voltage, into a predetermined alternating output voltage. A bridge circuit configured as a half-bridge is connected with the output of the voltage transformer and with the gas discharge lamp being disposed in the diagonal of the half-bridge. The voltage transformer includes a transformer that ensures a potential separation between the mains voltage at the input and the bridge circuit. Due to an unavoidable stray capacitance between the gas discharge lamp and components, such as, for example, a light fixture disposed in the vicinity of the lamp, an average potential of zero volts will be established between the lamp and the components.

Other suitable voltage transformers for operating a gas discharge lamp are known from the textbook by U. Tietze and Ch. Schenk, entitled "Halbleiter-Schaltungstechnik" [Semiconductor Circuit Technology], 6th Edition, 1983, published by Springer-Verlag, pages 545–552. Described are basic circuits of voltage transformers such as, for example, an up-transformer and inverting transformers without potential separation as well as single-ended flyback converters, single-ended flow converters and push-pull converters with potential separation during the transformation.

When operating a gas discharge lamp, care must be taken that no direct current component develops that flows through the lamp to avoid ion migration. Already in the year 1938, the textbook by Dr. W. Uyterhoeven, entitled "Elektrische Gasentladungslampen" [Electrical Gas Discharge Lamps], published by Springer-Verlag, 1938, pages 249–252, pointed out that the service life of gas discharge lamps, demonstrated by the example of sodium high pressure lamps, is limited, among others, by the interaction of the sodium ions with the lamp body.

SUMMARY OF THE INVENTION

It is the object of the invention to provide a device for operating a gas discharge lamp in which the gas discharge lamp has a long service life.

The above object is generally achieved according to the present invention in that in a device for operating a gas discharge lamp of the type initially mentioned above, and wherein a component which is able to carry a potential is disposed in the vicinity of the lamp such that an electric field is able to develop between the lamp and the component, the voltage transformer feeds a predetermined direct voltage to the bridge circuit, and the component is connected with that output terminal of the voltage transformer at which the potential is positive with respect to that at the other terminal.

The device according to the invention is based on the realization that an average potential of zero volt between the lamp and at least one component able to carry an electrical potential and disposed in the vicinity of the lamp is not sufficient in all cases to reliably prevent undesirable ion migration, particularly a diffusion of ions into the lamp body. Such a component is, for example, a lamp socket or a lamp fixture in which the lamp is installed. The component, however, is not limited to the lamp fixture. Generally, the component may be a component disposed in the vicinity of the lamp, with it being significant that this component is able to carry an electrical potential so that an electrical field may develop between the lamp and the component. It is therefore also not necessary for the component to be electrically conductive. It must merely be possible that a charge equalization can take place.

With the measure according to the invention that the component is connected with that terminal at the transformer output at which the potential is positive with reference to that at the other terminal, it is obviously possible, according to experimental results, to at least reduce the diffusion of ions into the lamp body. This increases the service life of the gas discharge lamp which ends, on the one hand, by discoloration or reduction of the emitted radiation and, on the other hand, in an extreme case by breakage of the lamp.

Advantageous modifications and improvements of the device according to the invention are defined in the dependent claims.

A particularly simple realization of the voltage transformer is possible with an inverse transformer in which the negative pole of an input direct voltage source is connected with that terminal of the output at which the positive potential appears. This configuration is advantageous particularly if the negative pole of the input direct voltage source is connected with the ground terminal of an electrical device because frequently the component in the vicinity of the lamp is also connected with the ground terminal of the device. With respect to the negative output voltage of the inverse transformer, the component connected with the ground terminal of the circuit then always has a positive potential.

Another advantageous embodiment provides for the realization of the voltage transformer as a transformer including a separating transformer. The potential separation between the direct input voltage source and the bridge circuit permits the simple connection of the component in the vicinity of the lamp with the positive terminal at the output of the voltage transformer.

The device according to the invention is particularly suitable for the operation of high pressure gas discharge lamps disposed in a motor vehicle headlight. In that case, the component in the vicinity of the lamp is the headlight fixture. If the headlight fixture is made entirely of plastic, the motor vehicle chassis takes the place of the headlight fixture.

Further advantageous modifications and improvements will become evident from the further dependent claims in conjunction with the description below.

DETAILED DESCRIPTION OF THE PREFERRED EMBODIMENTS

Figure 1:
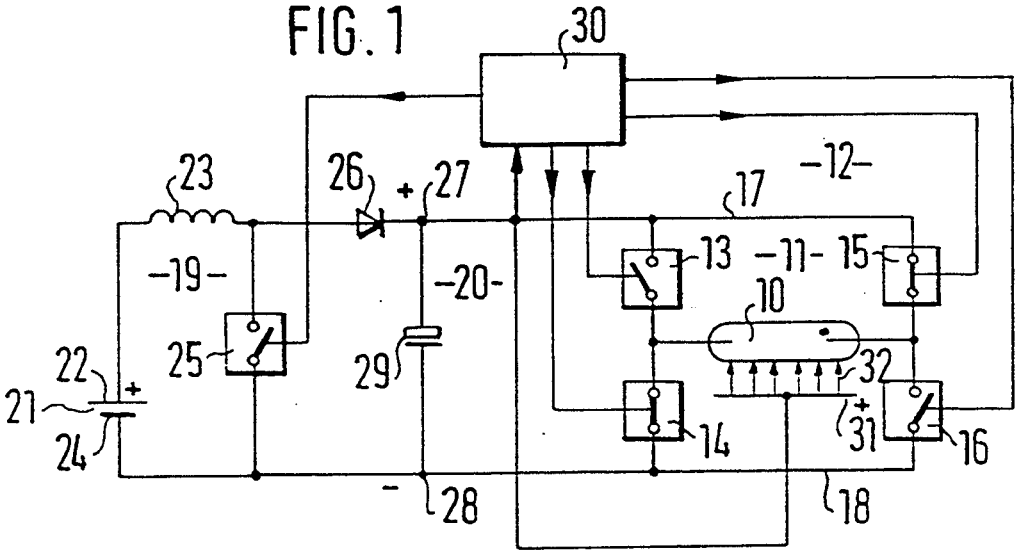
FIG. 1 depicts an electronic input device for a gas discharge lamp including a simple voltage transformer without potential separation.

FIG. 1 shows a gas discharge lamp 10 that is disposed in the diagonal 11 of a bridge circuit 12. Bridge 12 includes pairs of series connected switching means 13, 14 and 15, 16, with the series connections in each case being connected between a first and a second bridge input line 17, 18. The bridge diagonal 11 lies between a connection of switching means 13, 14 of the one series circuit and the connection of switching means 15, 16 of the other series circuit.

The electronic input device includes a voltage transformer 19 which converts a given input voltage into a predetermined voltage appearing at the output 20 of transformer 19. FIG. 1 shows, as the example of an input voltage source 21, a battery whose positive pole 22 is connected with a coil 23. A voltage transformer switching means 25 is provided between the other terminal of coil 23 and the negative pole 24 of battery 21. The anode terminal of a diode 26 lies at the connection between coil 23 and voltage transformer switching means 25. The cathode of diode 26 is connected with a first terminal 27 at the output 20 of voltage transformer 19. The first terminal 27 exhibits a positive potential compared to a second terminal 28 at the output 20 of voltage transformer 19. The second terminal 28 is connected with the negative pole 24 of battery 21 as well as with the voltage transformer switching means 25. A smoothing capacitor 29 lies between the first terminal 27 and the second terminal 28 at the output 20 of voltage transformer 19.

The first terminal 27 at output 20 is connected with the first bridge input line 17 and the second terminal at output 20 is connected with the second bridge input line 18. A control circuit 30 outputting appropriate control signals is provided for the electronic actuation of switching means 13, 14 and 15, 16 and of voltage transformer switching means 25. Control circuit 30 is connected with the first terminal 27.

A component 31 disposed in the vicinity of lamp 10 and able to carry an electrical potential is connected to the first terminal 27 at the output 20 of voltage transformer 19, at which the positive potential appears. This component is arranged in such a manner that an electrical field 32 is able to develop between lamp 10 and component 31. The potential of component 31 is always positive relative to the potential appearing at lamp 10.

Figure 2:
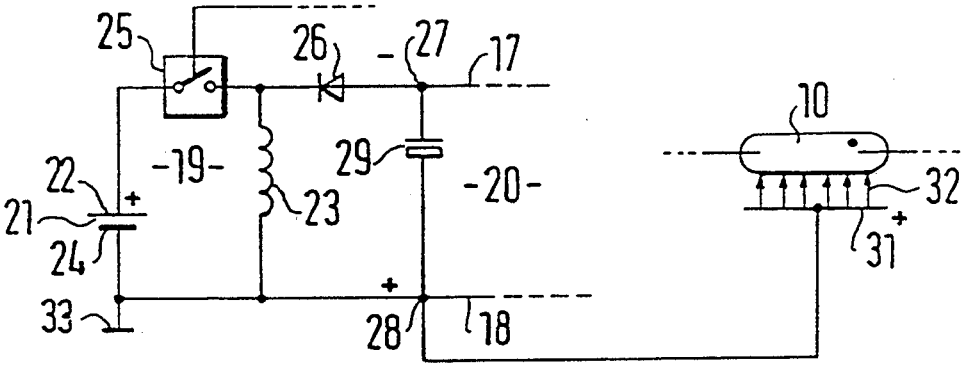
FIG. 2 depicts an embodiment including an inverse transformer without potential separation.

In FIG. 2, the components coinciding in function with the components shown in FIG. 1 are given the same reference numerals. The significant difference between the circuit diagram of an electronic input device shown in FIG. 1 and that shown in FIG. 2 is the different configuration of the voltage transformer 19. In FIG. 2, the arrangement of coil 23 is exchanged with that of the voltage transformer switching means 25 of FIG. 1. Consequently, switching means 25 lies directly at the positive pole 22 of battery 21, while coil 23 lies at the other terminal of switching means 25 and leads from there to the negative pole 24 of the battery. Also changed is the connection of diode 26, whose anode in FIG. 2 is connected with the first terminal 27 of output 20 of voltage transformer 19. If capacitor 29 is a capacitor of a predetermined polarity, its terminals in FIG. 2 must be exchanged compared to those of FIG. 1. Component 31 in FIG. 2 is connected with the second terminal 28 of output 20 of voltage transformer 19. The second terminal 28 has a positive potential relative to first terminal 27. The second terminal 28 is connected with the negative pole 24 of battery 21 which is simultaneously connected the ground terminal 33 of the device.

Figure 3:
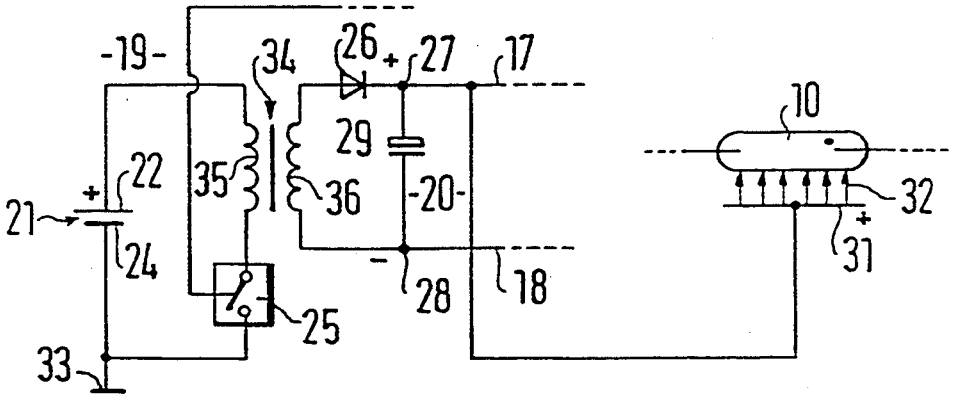
FIG. 3 depicts an embodiment including a voltage transformer with potential separation during the transformation.

FIG. 3 shows a further embodiment of an electronic input device which differs in the configuration of voltage transformer 19 from the circuit diagrams shown in FIGS. 1 and 2. The components shown in FIG. 3 which correspond to those of FIGS. 1 and 2 are given the same reference numerals in FIG. 3. Instead of the coil 23 shown in FIGS. 1 and 2, a separating isolation transformer 34 is provided in FIG. 3 whose primary winding 35 is connected, on the one hand, with the positive pole 22 of battery 21 and, on the other hand, with the voltage transformer switching means 25. Switching means 25 is connected with the negative pole 24 of battery 21 which is connected with the ground terminal 33 of the device. A secondary winding 36 of transformer 34 is connected, on the one hand, by way of diode 26 with the first terminal 27 and, on the other hand, directly with the second terminal 28 at the output 20 of voltage transformer 19. The cathode of diode 26 is connected with the first terminal 27. With this polarity of diode 26, a positive potential is present at the first terminal 27 of output 20 with respect to the potential at the second terminal 28. Component 31 is connected with the first terminal 27.

The device according to the invention as shown in FIG. 1 operates as follows:

Voltage transformer 19 transforms the voltage from source 21 into a voltage required to operate gas discharge lamp 10. At its output 20, voltage transformer 19 outputs a direct voltage. The source 21 is, for example, an alternating (mains) voltage which is initially rectified before it is fed to the voltage transformer. The source 21 may also be, for example, the battery shown in the drawing figures. It directly exhibits the given direct voltage. With respect to the mode of operation of the voltage transformer 19 shown in FIG. 1 as well as the embodiments shown in the other two figures, reference is made to the above-cited prior art, the textbook by U. Tietze and Ch. Schenk, entitled "Halbleiter Schaltungstechnik" [Semiconductor Circuit Technology]. The voltage transformer 19 shown in FIG. 1 is consequently configured, for example, as a step up transformer, with no potential separation being provided between battery 21 and output 20. The inductance of coil 23 and the capacitance of capacitor 29 can be determined from the formulas given in the cited literature. The output voltage can essentially be determined from the ratio between the on state and the off state of the voltage transformer switching means 25 which receives the appropriate turn-on signals from control circuit 13. The ratio is determined by the control circuit as a function of the output voltage of voltage transformer 19 appearing at the first terminal 27.

The direct voltage appearing at the two terminals 27 and 28 at the output 20 of voltage transformer 19 is fed to bridge circuit 12 by way of the two bridge input lines 17 and 18. In the illustrated embodiment, bridge circuit 12 is configured as an H bridge in which pairs of switching means 13, 14 and 15, 16 are connected in series between the two bridge input lines 17 and 18. Switching means 13, 14 and 15, 16, as well as voltage transformer switching means 25 are, for example, switching transistors, preferably field effect transistors. Lamp 10 is connected in bridge diagonal 11 which lies between the two connecting lines for the one switching means 13, 14 and the other switching means 15, 16. By way of a time control for switching means 13, 14 and 15, 16 provided by control circuit 30, lamp 10 is operated with an alternating voltage derived from the direct voltage present at the output 20 of voltage transformer 19. FIG. 1 shows the state in which switching means 14 and 15 are closed while switching means 13 and 16 are open. During the next cycle of operation, switching means 14 and 15 are opened and switching means 13 and 16 are closed. In connection with the control, care must be taken that the current flowing through lamp 10 is free of averages. This is accomplished in that the switching times for switching means 13, 14 and 15, 16 are always of identical length. Instead of the bridge circuit 12 shown in FIG. 1 which includes four switching means 13, 14 and 15, 16, a half-bridge circuit is also suitable in which two series connected switching means are replaced by capacitors. Further components required for operation of lamp 10, for example to limit the current flowing through lamp 10 or to ignite lamp 10, are not shown in the drawing figures since they are of subordinate significance for the present invention.

Due to the stray capacitances between the lamp and at least one component 31 in the vicinity of lamp 10, an electrical field may develop between component 31 and lamp 10. Component 31 is, for example, a lamp socket or a lamp fixture in which lamp 10 is installed. If the lamp fixture is made entirely of plastic, further components outside of the lamp fixture may also act as component 31.

In the embodiment of the electronic input device shown in FIG. 1, an electrical field 32 having an average value of zero will be built up due to the mentioned stray capacitance between lamp 10 and a component 31 disposed in the vicinity thereof. This assumption is applicable under the condition that component 31 is not in conductive connection with any circuit point of the circuit arrangement shown in FIG. 1. According to the invention, it is provided that component 31 is connected with terminal 27 at the output 20 of voltage transformer 19 which exhibits a potential that is positive with respect to that at the other terminal 28. With this measure it is ensured that the average potential across lamp 10 is always negative compared to the positive potential of component 31. It has been found experimentally that, with this measure, premature aging of lamp 10 can be reliably prevented, with this effect probably being based on the fact that the positive potential of the environment of lamp 10 keeps the ions occurring in the lamp away from the lamp fixture and pushes them into the plasma.

In the assumption that component 31 is already connected with a ground terminal on the device or, for example, with an operating ground with which one pole 22, 24 of source 21 is also connected, component 31 cannot be connected with the first terminal 27 at output 20 of voltage transformer 19. For that case, the configuration of voltage transformer 19 shown in FIG. 2 is particularly advantageously suitable. One pole 22, 24 of source 21, in the illustrated example the negative pole 24, is connected with the electrical ground terminal 33 of the device which is also connected with component 31. Voltage transformer 19 is realized as an inverse transformer in which the polarity of an input voltage is transformed into an inverse polarity at the output 20 of transformer 19. With respect to the mode of operation of transformer 19, reference is made here again to the already cited text portion. The connection between component 31 shown in FIG. 2 and the second terminal 28 may already exist in this realization without it requiring an additional connection. This case is applicable particularly if component 31 is a lamp socket, a light fixture or at least one other component 31 that is connected with the electrical ground terminal 33 of the device.

The configuration of voltage transformer 19 shown in FIG. 3 has the advantage of a potential separation between source 21 and the output 20 of transformer 19. This advantage is made possible by separating isolation transformer 34. FIG. 3 shows the example of a flyback converter circuit. The particular advantage of the potential separation during the transformation is that, independently of whether component 31 is connected with the electrical ground terminal 33 of the device or with an operating ground terminal, it can always be easily connected with the terminal 27, 28 at output 20 of voltage transformer 19, which has a potential that is positive with respect to that at the other terminal 27, 28.

We claim:

1. A device for operating a gas discharge lamp comprising:

a voltage transformer for transforming a direct voltage of an energy source into a predetermined direct output voltage, the voltage transformer having a first output terminal and a second output terminal, with the first output terminal having a potential which is positive with respect to a potential of the second output terminal;

a bridge circuit having inputs connected to the first and second output terminals of the transformer and a diagonal connected to the lamp for providing an AC potential to the lamp; and at least one component capable of carrying an electric potential disposed in the vicinity of the lamp such that an electrical field develops between the lamp and the component, with the component being connected to the first terminal of the voltage transformer.

2. A device according to claim 1, wherein the voltage transformer is an inverse transformer, and the negative pole of the energy source is connected to the first output terminal and to the component.

3. A device according to claim 2, wherein the inverse transformer includes, a voltage transformer switching means having a first terminal and a second terminal, with the first terminal of the voltage transformer switching means being connected to the positive pole of the energy source;

a coil having a first terminal and a second terminal, with the first terminal of the coil being connected to the negative pole of the energy source and the second terminal of the coil being connected to the second terminal of the voltage transformer switching means, and a diode being having a cathode connected to the second terminal of the voltage transformer switching means and to the second terminal of the coil, and an anode connected with the second output terminal of the voltage transformer.

4. A device according to claim 1, wherein the voltage transformer includes a separating transformer for galvanically separating the energy source from the output terminals of the voltage transformer.

5. A device according to claim 4, wherein the voltage transformer is a flyback converter circuit.

6. A device according to claim 2, wherein the negative pole of the energy source is connected to an electrical ground terminal of the device and to the component.

7. A device according to claim 2, wherein a battery is provided as the energy source.

8. A device according to claim 1, wherein the gas discharge lamp is a headlight of a vehicle.

9. A device according to claim 8, wherein the negative pole of the energy source is electrically connected to a chassis of the vehicle.

10. A device according to claim 1, wherein the component has the same potential as the first output terminal.

* * * * *